US005601856A

United States Patent [19]

Kretzschmar et al.

[11] Patent Number: 5,601,856

[45] Date of Patent: Feb. 11, 1997

[54] SPINNING BEAM

[75] Inventors: Willi Kretzschmar, Grosswallstadt; Erik Ortmayer, Linsengericht, both of Germany

[73] Assignee: Rieter Automatik GmbH, Grossostheim, Germany

[21] Appl. No.: 419,986

[22] Filed: Apr. 11, 1995

[30] Foreign Application Priority Data

Sep. 8, 1993 [DE] Germany ..... 9313586 U
Jul. 26, 1994 [CH] Switzerland ..... 02350/94

[51] Int. Cl.[6] ..... D01D 4/00

[52] U.S. Cl. ..... 425/378.2; 264/178 F; 425/192 S; 425/382.2; 425/464

[58] Field of Search ..... 425/378.2, 378.1, 425/464, 191 S, 192 S, 144, 143, 382.2; 264/176.1, 178 F

[56] References Cited

U.S. PATENT DOCUMENTS

| | | | |
|---|---|---|---|
| 2,707,306 | 5/1955 | Weber et al. | 425/382.2 |
| 3,466,357 | 9/1969 | Schippers et al. | 425/192 S |
| 3,655,314 | 4/1972 | Lenk et al. | 425/382.2 |
| 3,767,347 | 10/1973 | Landoni | 425/382.2 |
| 3,817,672 | 6/1974 | Lenk | 425/378.2 |
| 3,830,617 | 8/1974 | Coates et al. | 425/464 |
| 4,099,898 | 7/1978 | Beck | 425/382.2 |
| 4,350,127 | 9/1982 | Ogasawara et al. | 425/192 S |
| 4,437,827 | 3/1984 | Moderlak et al. | 425/378.2 |
| 4,645,444 | 2/1987 | Lenk et al. | 425/464 |
| 4,663,096 | 5/1987 | Uenoyama et al. | 425/378.2 |
| 4,696,633 | 9/1987 | Lenk et al. | 425/378.2 |
| 4,698,008 | 10/1987 | Lenk et al. | 425/378.2 |

FOREIGN PATENT DOCUMENTS

| | | | |
|---|---|---|---|
| 0163248 | 12/1985 | European Pat. Off. . | |
| 60314 | 4/1970 | Germany . | |
| 8407945 | 7/1984 | Germany . | |
| 9313586 | 11/1993 | Germany . | |
| 2639382 | 3/1978 | Switzerland . | |
| 2096049 | 8/1982 | United Kingdom | 425/382.2 |
| 1853/93 | 6/1993 | United Kingdom . | |
| PCT/CH94/00123 | 6/1994 | WIPO . | |

OTHER PUBLICATIONS

Chemiefasern/Textilindustrie, Nov. 1993, pp. 884–886, DR–ING. Klaus Meier "Energieflüusse und Einsparpotentiale bei der Herstellung und Verarbeitung von Poy".

Chemiefasern/Textilindustrie, Sep.1994, pp. 559–561, Dr. K. Meier "Analyse der Wärmeströme auf die Spinndüse bei der Herstellung textiler Filamentgarne".

"Energy flows and savings potential in POY production and processing", by Dr. K. Meier, pub. Chemiefasern/Textilindustrie, vol. 43/95, pp. E150–E151, Nov. 1993.

"Textile filaments: improved temperature control for yarn formation", by Dr. K. Meier, pub. Chemiefasern/Textilindustrie, vol. 44/96, pp. E85–E86, Oct. 1994.

*Primary Examiner*—Jay H. Woo
*Assistant Examiner*—Duane S. Smith
*Attorney, Agent, or Firm*—Burns, Doane, Swecker & Mathis, LLP

[57] ABSTRACT

The heat transmission from the heating box of a spinning beam to the nozzle package carried therein in a nozzle throat is improved in such a way that the fixing device for the package is provided with heat receiving elements. These elements are subjected to saturated vapor in operation and are provided with condensation surfaces so as to receive heat from the saturated vapor. The heat received is transmitted to the package via at least one heat bridge.

11 Claims, 5 Drawing Sheets

SPINNING BEAM

This application is a continuation of presently pending International Application Ser. No. PCT/IB94/00268 filed Sep. 7, 1994.

The invention relates in a first aspect to a spinning beam for melt spinning filaments made from synthetic polymers, in particular for spinning fine filaments. The beam consists, for example, of a heating box with integrated melt pumps, melt conduits and receiving means for spinning nozzles. The melt coming from the preparation means and entering the beam is distributed to the spinning pump and nozzle pots via the melt passages integrated in the spinning beam.

The invention relates in a second aspect to a heating system for an exchangeable part of a spinning beam for spinning endless filaments, e.g., made from polyamide, polyester or polypropylene.

One example for such a part is the so-called nozzle package, which during the operation is received in the spinning beam in a "nozzle throat" and which has to be exchanged periodically by a similar package for cleaning purposes. The nozzle throat is provided in a heating box. The nozzle package contains the spinneret, which is provided with bores, wherein the filaments are formed from the melt mass. The nozzle package, and in particular the spinneret, has to maintain during operation a predefined temperature, with heat continuously flowing off from the package. The package per se usually does not comprise a heating apparatus. Its heating loss must be compensated for by heat transmissions from its carrier. In such an arrangement, the problem of sufficient heat transmission from the carrier section to the exchangable part arises.

BACKGROUND

From DE-Gbm 84 07 945 a spinning beam is known which is provided with a circular cross section. As an advantage of the embodiments made therein it is stated that the nozzle packages where the filaments are formed and the spinning pumps which convey polymers into these packages are enclosed by side walls and that the intermediate space is filled directly and evenly with vaporous heat carriers. A similar arrangement is shown in EP 163 248 (FIG. 4).

To prevent heat losses, the spinning beams are substantially insulated on the outer surfaces. It is not possible from a design point of view to sufficiently insulate the outer surface for facing downwards in the zone of the nozzle packages as owing to increased layer thickness the instant cooling of the filaments directly after their exit from the nozzle bores by bringing up a cooling device, in particular a blow shaft, would be prevented.

As particularly during the production of very fine filaments the quantity of the passing molten polymer is relatively small, so that heat losses either cannot be offset or are very difficult to offset again by supplying heat from the molten polymer, spinning beams must be supplied, as was outlined above, with a heat carrier heated up to the vapor phase, so that the said heat losses can be offset by the condensation of the vapor.

In this respect it is particularly important to heat the uninsulated spinnerets sufficiently and evenly. This object can only be achieved insufficiently with the spinning beams in accordance with the state of the art, because particularly in this zone the heat transfer by condensation of a vaporous heat carrier is limited most strongly owing to the unfavorable geometrical situation and the accumulating condensate and, at the same time, the heat losses of the beam are at its highest owing to the insulation which can be arranged only insufficiently.

Examples of measures that have been undertaken to this point to solve the problems of adequate heat transfer to the spinneret are disclosed in EP-A-163248. The measures mentioned above are mainly aimed at forming a heat transfer path (a "heat bridge") between the rigidly mounted carrier parts and the nozzle package. It is assumed generally (without providing any further information) that the system is capable of supplying the required heat quantity to the carrier end of the heat bridge. This assumption is not justified that easily.

SUMMARY OF THE INVENTION

The object of the invention in its first aspect consists of reducing the heat losses of a spinning beam. This object is achieved by a spinning beam with a heating box, in which a vapor phase heat carrier can condense on the surfaces to be heated and in which the heating block profile tapers downwardly or at the bottom of the spinneret (nozzle packages). The space required for heating the spinning pump blocks which protrude relatively highly into the upper zone of the beam is maintained. A geometrical change of the inner space structure in the lower zone by providing additional ribs for increasing the heat exchange surface, whilst maintaining simultaneously the discharge of the condensate, can contribute substantially to the improvement of heating the nozzle packages, as will be explained below in greater detail in connection with the second aspect of the invention.

Furthermore, the above-mentioned specifications do not provide any solutions for two further problems, namely the inexpensive connection of the pump drive with the spinning pump by taking into account the unavoidable heat expansion of the spinning beam;

the production of a vaporous heat carrier and its supply to the heating box with acceptable heat losses in the feed system.

These two objects are achieved by a spinning beam in which a vapor phase heat carrier can condense on the surfaces to be heated, in which spinning pump drives are attached to consoles rigidly attached to the heating box, and in which the heat carrier vapor is produced in an evaporator integrated in the spinning beam insulation so that the connecting link may be short. The evaporator is preferably connected with the spinning beam by one or several condensate or vapor lines. In a less preferable arrangement, however, it may be provided with a combined, sufficiently dimensioned vapor line with simultaneous condensate return.

In a preferred solution all three above-mentioned objects are achieved by a combination of the features mentioned.

It is the object of this invention in a second aspect to arrange the heat flow between a heated carrier in a spinning beam and a carried part in such a way that this flow always flows in a predefined direction.

This object is achieved by providing a spinning beam with a heat receiving element, the element having a surface which is subjected to a heating medium so that the element conducts heat from the heating medium via the surface to at least one heat bridge such that a temperature drop occurs in a direction away from the heat box.

Owing to the fact that the temperature drop always extends in the direction of the carried part, it is ensured that heat is not additionally withdrawn from the nozzle package via the heat bridge. If it is ensured in addition that the temperature drop extends as steeply as possible in the direction of the carried part, the heat transmission can be optimized towards the carried part.

The heating system preferably comprises a condensation heating with saturated vapor as the heating medium. Preferably, an at least sufficient condensation surface will be provided at the heat bridge so as to ensure the required heat transfer from the saturated vapor to the heat bridge. The condensation surface may also be provided at a distance from the heat bridge, subject to the condition that the heat flow from the surface to the bridge is not impaired to the extent that the temperature drop intended is endangered thereby.

The condensation surface is preferably arranged in such a way and/or such an auxiliary means is provided that the surface is subjected to saturated vapor (but not condensate) during operation. The condensation surface is preferably so smooth as to favor the flowing off of the condensed saturated vapor. The surface tension can also be increased by a coating, for example, so as to promote the formation of droplets. The auxiliary means may comprise a discharge conduit, for example, for the continuous removal of condensate from the surface.

Usually, a plurality of heat bridges will be formed which are each allocated to the parts to be heated. In this case, individual heat receiver elements may be provided which are each allocated to a heat bridge. It ms also possible to provide a larger heat receiving element which is allocated to a plurality of heat bridges (e.g., all bridges).

The condensation surface is to be arranged as large as possible. It should also enable a heat guiding path from the surface to the bridge. The path is provided with a sufficiently large (preferably the largest possible) cross section. The surface may also be provided on an element which tapers in a direction away from the bridge.

BRIEF DESCRIPTION OF THE DRAWINGS

Embodiments in accordance with the invention are outlined below in greater detail by reference to the Figures of the drawings, in which.

DETAILED DESCRIPTION

Figure 1:
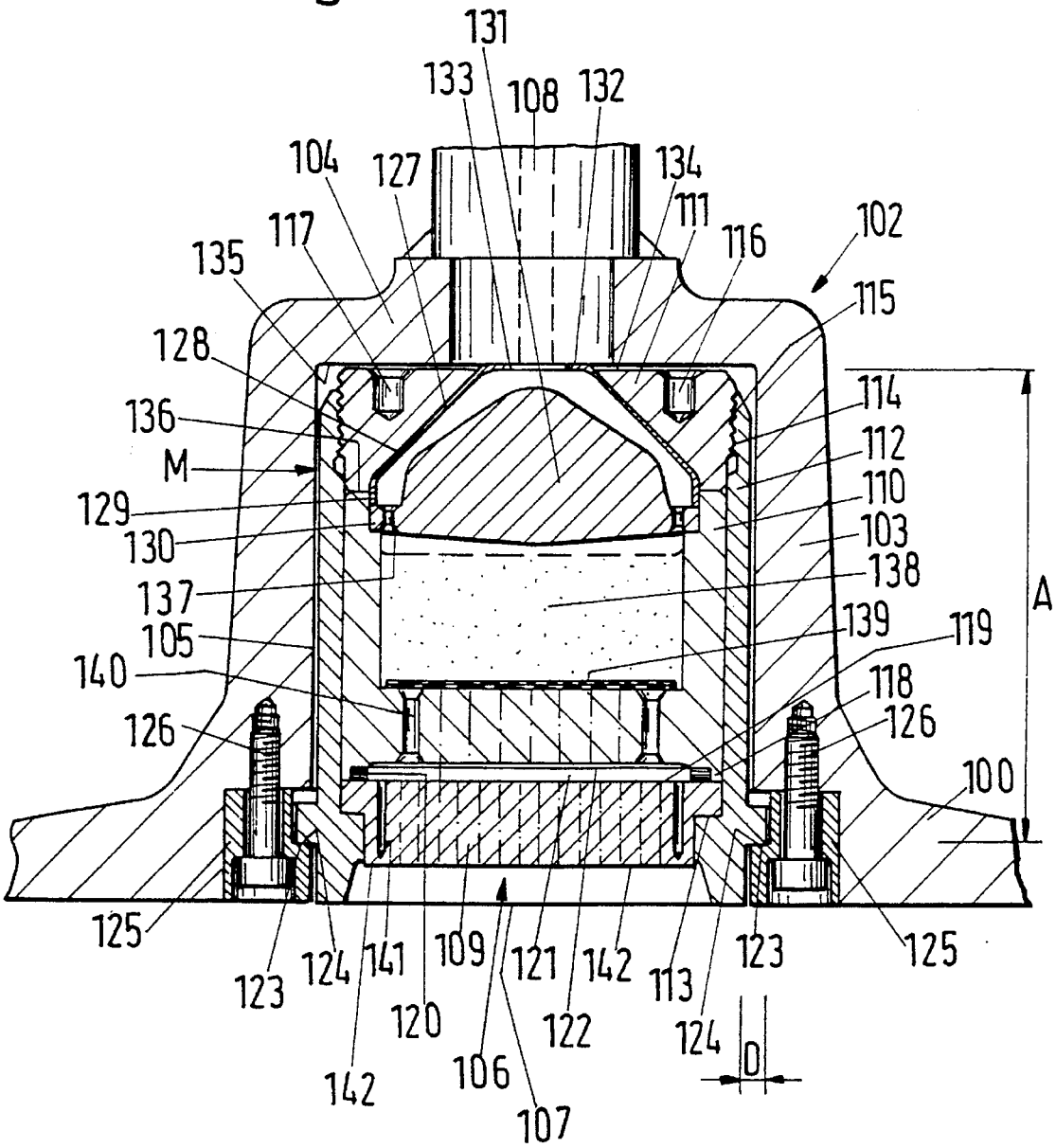
FIG. 1 schematically shows part of a spinning beam in a cross-sectional view.

FIG. 1 shows a section from a spinning beam with a nozzle package (in particular a spinneret fixing device). The spinning beam comprises a heating box 100, into which project melt conduits and melt pumps (not shown), as is shown, for example, in the FIGS. of DE-Gmb 8407945. A receiving means 102 is inserted in the heating box 100, e.g. by welding, which means consists of a side wall 103 which is inwardly closed through floor 104. The receiving means 102 encompasses the cylindrical inner space 105 (the "nozzle throat"), in which nozzle pot 106 is inserted. For this purpose the inner chamber 105 opens via cylindrical opening 107 to the outer space. Floor 104 is penetrated by the melt duct 108 which is connected to the melt pump (not shown).

The nozzle pot 106 is a rotation body. Similar to receiving means 102, it is shown in FIG. 1 in a sectional view. The nozzle pot 106 consists of layered components, namely the spinneret 109, the filter casing 110 and the threaded ring 111. These three components are inserted in the hollow cylinder 112, which carries the spinneret 109 with its shoulder 113. The hollow cylinder 112 is provided with the inner thread 114 at the side of the threaded ring 111, into which thread the threaded ring 111 with its outer thread 115 is screwed. To screw the threaded ring 114 into the hollow cylinder 112, threaded ring 111 is provided with pocket-like holes 116 and 117, into which a matching hooked wrench fits. The screwing in of the threaded ring 111 into the hollow cylinder 112 is limited by the cylindrical projection 118 at the side of the filter casing 110 facing towards the spinneret 109. When the projection 118 engages the surface 119 of the spinneret 109 as the threaded ring 111 is screwed in, the whole length of the nozzle pot 106 is determined. Within the cylindrical projection 118 there is disposed an annular recess which is filled by packing ring 120. The packing ring 120 is pressed outwardly against the cylindrical projection 118 by the pressure of a mass to be processed, which mass fills out the intermediate space 121 between the surface 119 and the lower surface 122 of filter casing 110, thus resulting automatically in a seal adjusted to the pressure between the filter casing 110 and the spinneret 109 under the influence of this pressure.

The hollow cylinder 112, which as a component of nozzle pot 106 carries the spinneret with its shoulder 113, is held itself in the receiver 102, namely by means of shoulder 123, which in the shown built-in condition is opposed to the supports 124 on hollow cylinder 112. The shoulders 123 are components of the insert parts 125, which are inserted into the side wall 103 of receiving means 102 and are tightly screwed together with side wall 103 by means of bolts 126. The shoulders 123 and the supports 124 jointly form a bayonet catch which axially arrests the nozzle pot 106. Simultaneously, the bayonet catch forms via shoulders 123 and supports 124 a direct heat bridge, over which the spinneret 109 is heated directly. By turning the hollow cylinder 112 and thus the nozzle pot 106 by approx. 90°, the connection between receiver 102 and nozzle pot 106 is released. Nozzle pot 106 can be removed from receiver 102 through cylindrical opening 107 and can be disassembled into its parts, e.g., for cleaning the filter casing 110 and the spinneret 109.

During the insertion of nozzle pot 106 into the receiver 102 the packing disk 127 comes into effect, which is inserted substantially in a conical arrangement in threaded ring 111 which is provided with a conical inner surface 128 for receiving the packing disk 127. Packing disk 127 rests with its outer edge 129 on ring shoulder 130, which is a component of the melt distributor 131 resting on the filter casing 110. Said melt distributor 131 is here a part of nozzle pot 106. It is used to distribute in a favorable manner the melt flowing in through the melt duct 108 into the interior of the nozzle pot.

In the assembled condition of the nozzle pot 106 the packing disk 127 rests on ring shoulder 130, whereby it extends upwardly into floor 132 while engaging the conical inner surface 128 of threaded ring 111, which floor 132 encompasses through-hole 133 which is in alignment with the melt duct 108.

As is shown in FIG. 1, floor 132 of packing disk 127 projects slightly over the surface 134 of threaded ring 111, so that during the closing of bayonet catch the floor 132 sits tightly close to the lower surface 135 of base 104 of receiver 102. In this way the sealing between the base 104 of receiver 102 (penetrated by melt duct 108) towards nozzle pot 106 is brought about, namely by using the pressure prevailing in the interior of nozzle pot 106, which pressure presses the packing ring 127 against the lower surface 135 and the conical inner surface 128 of threaded ring 111 depending on the amount of this pressure. Furthermore, the packing disk 127 is pressed outwardly against the contact position 136 between threaded ring 111 and filter casing 110, so that a secure sealing is also achieved here.

During the operation the melt flow proceeds as follows: The melt moves from melt duct 108 through the through hole 133 to the melt distributer 131, through which the melt flows and reaches ducts 137, of which only two are shown. In the embodiment shown, there are approx. 124 of such ducts. Thereafter the melt flows through filter 138 which is closed downwardly by grid 139. Ducts 140 are further formed in filter casing 110 (there are approx. 50 such ducts), from where the melt reaches the intermediate space 121. Now the melt penetrates the spinneret 109, namely through bores 141, which end in the capillaries in the lower limiting surface 142 of spinneret 109. The individual filaments exit here, which are then joined into individual yarns.

Figure 2:
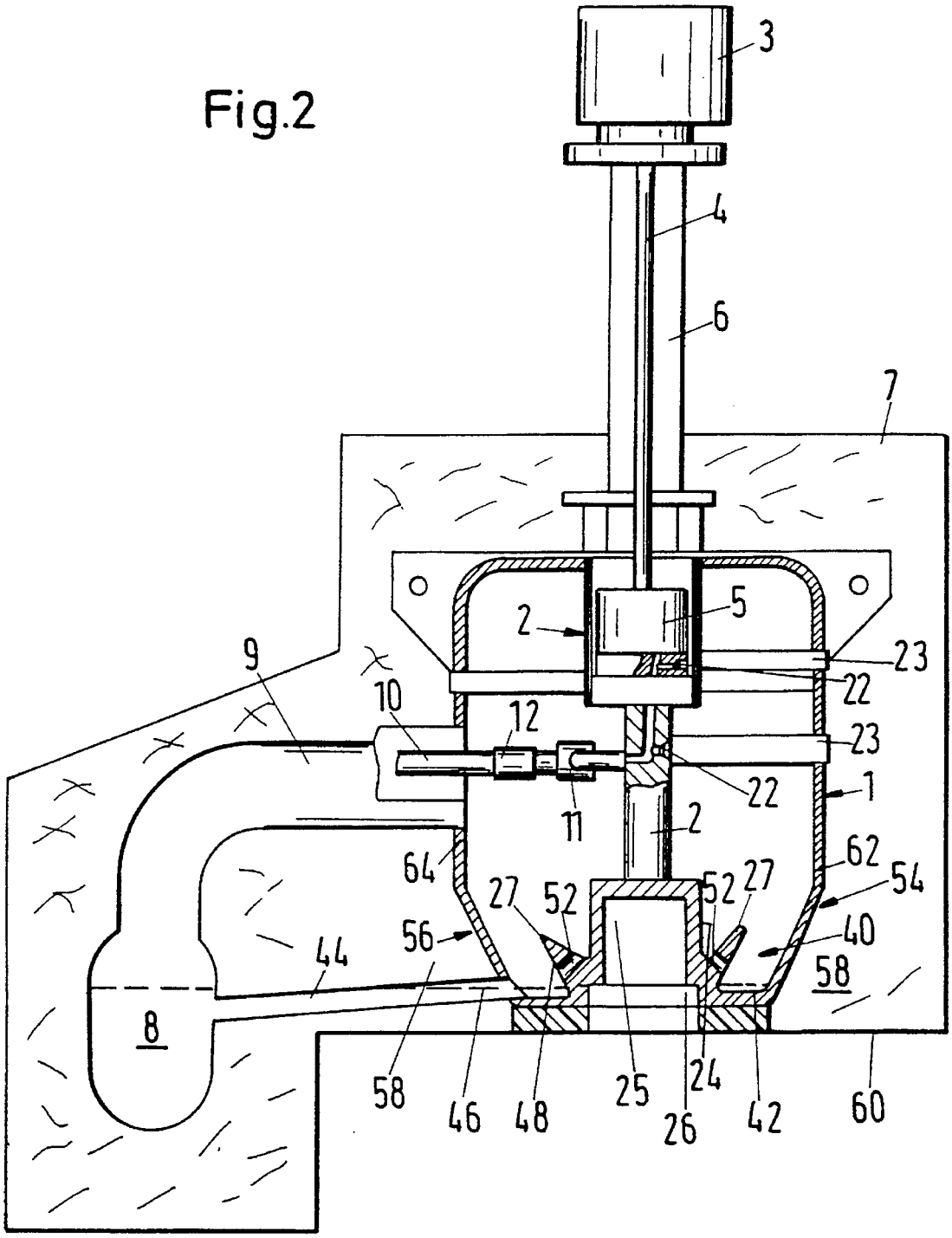
FIG. 2 schematically shows in a cross-sectional view a spinning beam in accordance with the present invention.

FIG. 2 shows a similar spinning beam for melt spinning polymers with a heating box 1 whose cross section is box-like or tube-like and which tapers in a wedge-like manner in the zone of the nozzle packages. In this box a heat carrier in the vapor phase can condense on the surfaces 2 to be heated. Components are welded into the heating box which are used for conveying the polymer melt from the melt conduit coming from the extruder and ending at heating box 1 to the spinning pumps and from there further on to the spinning nozzle packages insertable in the spinning beam from below. In this respect, this spinning beam has also been described in the article "Energieflüsse und Energiesparpotentiale bei der Herstellung und Verarbeitung von POY" (Energy Flows and Energy Saving Potentials in Producing and Manufacturing POY) (Author: Dr. Klaus Meier), published in "Chemiefaser/Textilindustrie" of November 1993. The content of said article is hereby included in the present description.

Spinning pumps 5 are provided in the beam in accordance with FIG. 2 which are driven by individual gear motors 3 via pump shafts 4, whereby the gear motors are mounted on consoles 6 which are rigidly connected to heating box 1 at a small distance from said pump shafts 4. The connections provide limited heat conductive capabilities. Therefore, the heat expansion of heating box 1 does not cause any misalignments of pump shafts 4 which have a negative effect on the function of the drive. Special support arrangements for the pump gear 3 and the alignment of the gear after the heating of the spinning beam are not necessary. In one embodiment of the spinning beam the spinning pumps 5 can be built into the heating box from above (vertical pump shaft); in another embodiment they can be built in from the side (horizontal pump shaft).

In contrast to the conventional solution, the embodiment shown does not require any independent suspension for the spinning pump drives 3. Such separate suspensions have the disadvantage that a considerable temperature drop prevails between the heating box and the motor carrier, which contributes substantially to different changes in length of the box and the carrier, thus leading to misalignments. In accordance with the present solution, the carriers and thus the motors also move along during any heat expansions of the heating box. This heat expansion accordingly only causes a negligible misalignment, so that the usual alignment of the pump drives with a heated spinning beam is no longer necessary. The significance will become clear when it is mentioned that the heating box can easily reach a length of 6 meters and that thereby the changes in length of the individual positions would add up.

Every console is arranged at a small (the smallest possible) distance from the respective spinning pump drive shaft. The connection of the console with the heating box is heat conductive at least to a limited extent.

In a conventional system for heating the box, the heating vapor preparation is provided at a central site for a plurality of spinning beams. This solution is efficient and cost effective as long as the evaporation is viewed per se. The balance will change, however, when the distribution losses are also taken into account. According to the present solution, every spinning beam is provided with its own evaporator.

Therefore, for the heat carrier the spinning beam 1 is provided with an evaporator 8 integrated in the insulation 7 of the spinning beam, so that the connecting line 9 from the evaporator 8 to the heating box 1 only reaches a minimal length. Thus, the heat loss of the usually long vapor line from a central processing site is eliminated. The Figures show that the path to be covered between the generator 8 and the box 1 is very short and well insulated. The heat losses are correspondingly low. This heating box is therefore particularly advantageous during the spinning of partly drawn yarns (POY) of finer titre (textile yarns).

The components in the interior of the heating box are as follows:

There is a tube conveying system 10 (FIG. 4) with distributors 11, static mixers 12 and stop valves 13 (FIG. 3) for interrupting the melt flow to the individual spinning pumps, so that on requirement a spinning pump can be exchanged without influencing the other spinning positions. This line system distributes the melt guided to the heating box to the pump blocks 14 (FIG. 3) welded into the said heating box. The pump blocks for their part are provided with mounting surfaces 15 (FIG. 3) for mounting spinning pumps 5 and with contact surfaces 132 for the bell-shaped packings 127 of the spinning nozzle packages (see FIG. 1).

The mounting surfaces for the spinning pumps are situated on the floor of pot-like recesses 17 of the heating box. The recesses 17 can be provided, for example, in that the part of the pump block 14 forming the mounting surface is welded to a tube portion 18 which penetrates the heating box wall. The arrangement of the pump block 14 enables the final processing of the mounting surface 15 before welding together the pump block with the tube portion 18, which brings about the connection with the heating box wall. The melt ducts 19 to the spinning pump and the ducts 20 to the nozzle packages within the pump block arise through deep-hole drilling. Every pump block 14 supplies four nozzle packages and accordingly comprises four ducts 20, of which one duct is shown in the left block 14 in FIG. 3 by way of a partial sectional view, and three ducts are indicated by broken lines.

A so-called protective plate 21 (FIG. 3) is disposed between the mounting surface 15 and the actual spinning pump 5. If the surface of the protective plate 21 showing towards the spinning pump should be inadvertently damaged during the exchange of the spinning pump, this protective plate 21 can be replaced without having to provide any additional follow-up work on pump block 14. Furthermore, different spinning pumps 5 can be mounted on the pump block 14 by providing different protective plates 21 with different arrangements of the melt ducts.

If required, bores for pressure sensors 22 (FIG. 2) can be attached in the protective plate 21. Protective tubes 23, which are in alignment with the bore axis/bore axes, are welded into the heating box and the tube portion encompassing spinning pump 5, so that pressure sensors can be screwed into the protective plate 21 or pump block 14 laterally from the outside.

The pump block(s) made from stainless steel is (are) welded to the nozzle block(s) 24 made from heat-resistant C-steel. Every nozzle block is provided with a number of pot-like bores 25, in which the nozzle packages are inserted from below. The bores start out from a flat U-shaped recess 26 on the lower side of the nozzle block.

A slot 28, which extends over all pot-like bores 25, is milled into the upper side of the nozzle block 24 in such a way that said bores are chamfered from above. The respective pump block 14 is inserted into said slot and welded together with the nozzle block.

The nozzle block 24 comprises a longitudinal carrier element (see in particular FIG. 3) which is welded into the floor section of the heating box. In the example shown, said floor section comprises a frame 70, which will be explained below in greater detail. The pot-like receivers 25 (compare with nozzle throats 105, FIG. 1) are bored into nozzle block 24, with a thin side wall 72 remaining inbetween. The nozzle throats 25 each receive a nozzle package, e.g., in accordance with FIG. 1.

Locking strips (not shown) are inserted from below into the U-shaped recess 26 on their longitudinal sides and thereafter screwed together with the nozzle block 24. By means of these strips and projections provided on the spinnerets below, the nozzle packages are form-locked with the nozzle block 24 by a 90° turn in the manner of a bayonet catch. A heat bridge comes about owing to the contacting surfaces of the locking strips and the projections on the nozzle package, which bridge supplies the nozzle package with additional heat in the zone of the spinneret.

In the interior of the heating box the nozzle block 24, which is adjacent to the U-shaped recess 26, is provided with wing-like condensation surfaces 27 which guide the condensation heat via a short path to the outer side of the nozzle block 24, 26, to the locking strips and to the lower side of the nozzle packages.

The chamber 40 near the lowermost surface 42 of the heating box is connected via a discharge tube 44 (FIG. 2) to the vapor generator 8. Accordingly, the vapor generator is disposed below the upper end of tube 44, where it opens out into the heating box. The vapor in the inner chamber of the heating box condenses on the surfaces of the heat sinks and the condensate flows downwards into the "gulley", which is formed by the preheated chamber 40. The condensate is collected in this gulley and flows therefrom via tube 44 back to the generator 8. The cross section of this gulley is selected in such a way that the level of condensate can only rise so high that the heat transfer to the lowermost section of the nozzle block 24 is not impaired.

By using an evaporation concept in accordance with the present invention it is possible to supply vapor as well as discharge condensate through a single conduit (not shown). This joint conduit must be provided with an adequate cross section, so that the vapor flows in the upper part in the direction of the heating box and the condensate on the floor of the conduit flows back to the evaporator.

The lower part of the box constitutes the source of the greatest heat losses. Owing to the tapering of the heating-box side walls 54, 56 it is possible to provide insulating material 58 between these walls and a mantle surface 60, which forms the upper end of the blow shaft (not shown). In this way it is possible to substantially reduce the heat losses of the heating box, which prevents a respective strain on the air-conditioning system. The vertical walls 62, 64 of the upper section of the heating box create space for a sufficient vapor quantity in the interior of the box so as to ensure the evenness of the temperature conditions in the heating box during the spinning.

The transfer of the heat to the lowermost section of the nozzle block 24 and the avoidance of heat losses in this section are particularly important in an embodiment in accordance with FIG. 1 because the spinneret 109 (FIG. 1) is situated there during the spinning. The surface 48 (FIGS. 2 and 3) is therefore arranged so as to guide condensate into the collecting gulley, whereby the floor of this gulley is slightly offset from the recess 26. In order to improve the heat transfer from the saturated vapor at the lowermost section of the nozzle block 24, it is provided with a rib 27 which projects upwardly inclined away from the surface 48. The rib is provided with holes 52 in the lowermost zone so as to enable the discharge of the condensate to the collecting gulley. The above-mentioned condensation surfaces are formed on said rib 27, which enable the rib 27 to function as heat receiving element. The ribs 27 extend from the cooler lower section of the unit to a chamber filled with vapor, whereby the vapor around the rib is adjacent neither to the condensate nor to the gulley floor.

The arrangement in accordance with FIG. 2 is particularly advantageous, because rib 27 can be formed in one piece with a profile which is mounted as a longitudinal part in the spinning beam and forms the above-mentioned chamber 70. Two heat bridges are formed for each nozzle package by supports 124 and shoulders 123 of the bayonet catch (FIG. 1), by means of which the nozzle package is held in the throat. The shoulders 123 extend radially outwardly from the mantle surface M of the package and are disposed diametrically opposite of one another. When the package is in the built-in condition, every shoulder 123 pushes against a respective detent surface (not shown). The shoulders 123 or the contact surfaces, respectively, are disposed in such an angular position with respect to the longitudinal axis of the package (i.e., with respect to the spinning direction) that the shortest possible heat flow paths come about between the heat bridges and the ribs 27. In an arrangement in accordance with FIG. 3, for example, they are preferably arranged in two rows which are parallel to the longitudinal axis of the frame.

Every heat bridge is provided with a predefined cross section. If a rib 27 were not present, this cross section would only be provided with a relatively small condensation surface in the lower edge section of the heating box. By means of rib 27 it is possible to extend considerably the condensation surface allocated to the heat bridge. This surface is also arranged not only in the lower edge section of the heating box as the rib extends from this section upwardly inclined. Rib 27 is therefore an example of a heat receiving element or heat guiding element which is provided with a condensation surface, which is subjected to saturated vapor in operation and which conducts heat from the saturated vapor in the heating box to the heat bridge.

The invention, however, is not limited to this example. The heat receiving element is not necessarily formed in one piece with a part of the heating box, but may be attached thereto. The heat receiving element is also not necessarily arranged as a longitudinal element which extends in the longitudinal direction of the spinning beam. It is possible, for example, that heat receiving elements are provided which are each allocated to a heat bridge and which, for example, are disposed in radially arranged planes or in planes which are transversal to the longitudinal direction. Examples are schematically shown in FIGS. 5A and 5B and shall be explained below in greater detail.

The invention is particularly advantageous in a spinning beam which is provided with heat bridges in the lower edge section of each throat so as to improve the heat transmission onto the spinneret. It is, however, not limited to this embodiment. It is known, for example, to provide a heat bridge between the heating box and the nozzle package by means of a seal around the melt supply, i.e., at the uppermost end of the throat. Such a heat bridge can also be provided when a more direct heat bridge is provided to the spinneret additionally in the lower edge section. A heat receiving element for improving the heat flow to a heat bridge via the seal may be arranged, for example, in accordance with FIGS. 6A and 6B.

Figure 3:
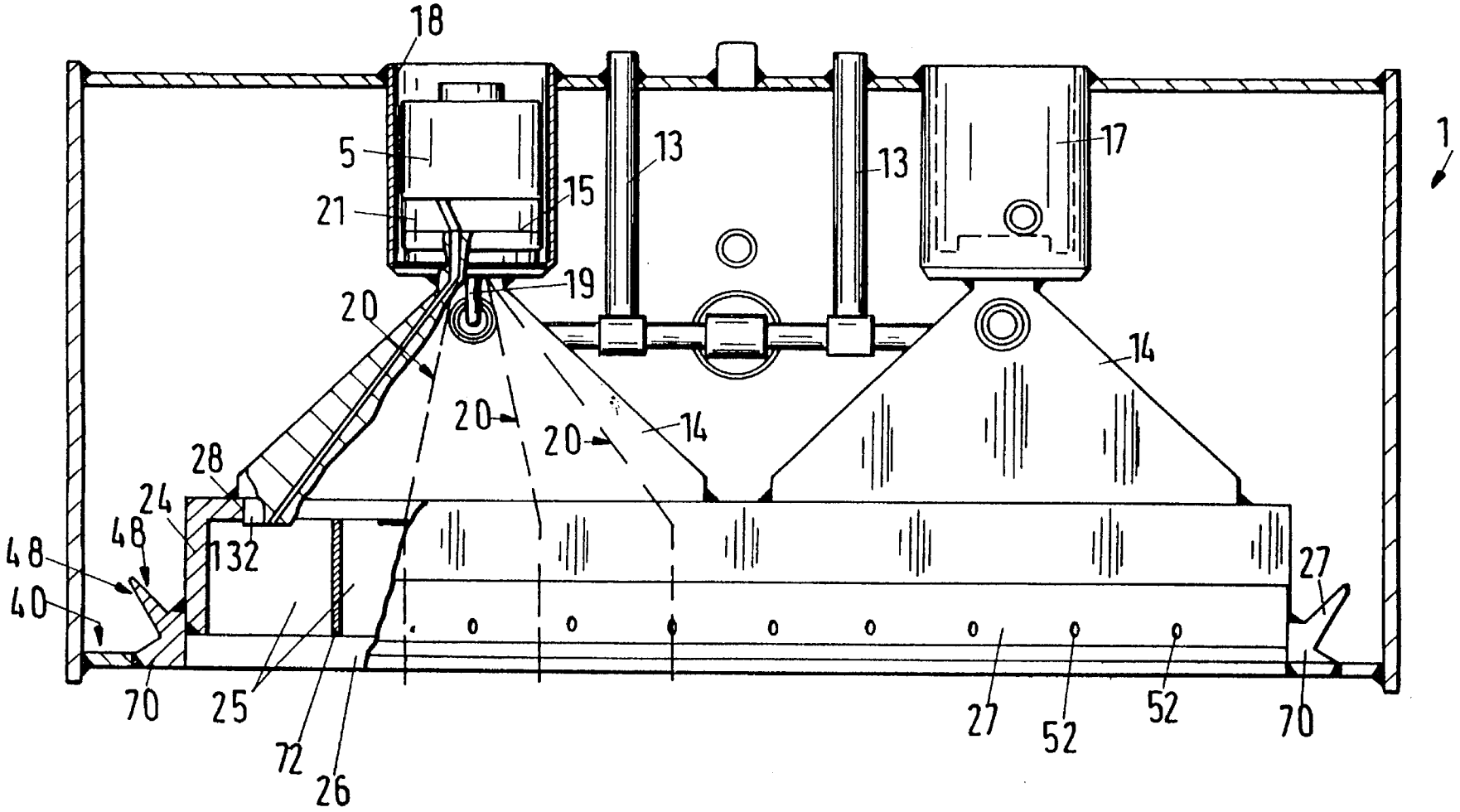
FIG. 3 shows a front view of the heating box of the spinning beam in accordance with FIG. 2.
Figure 4:
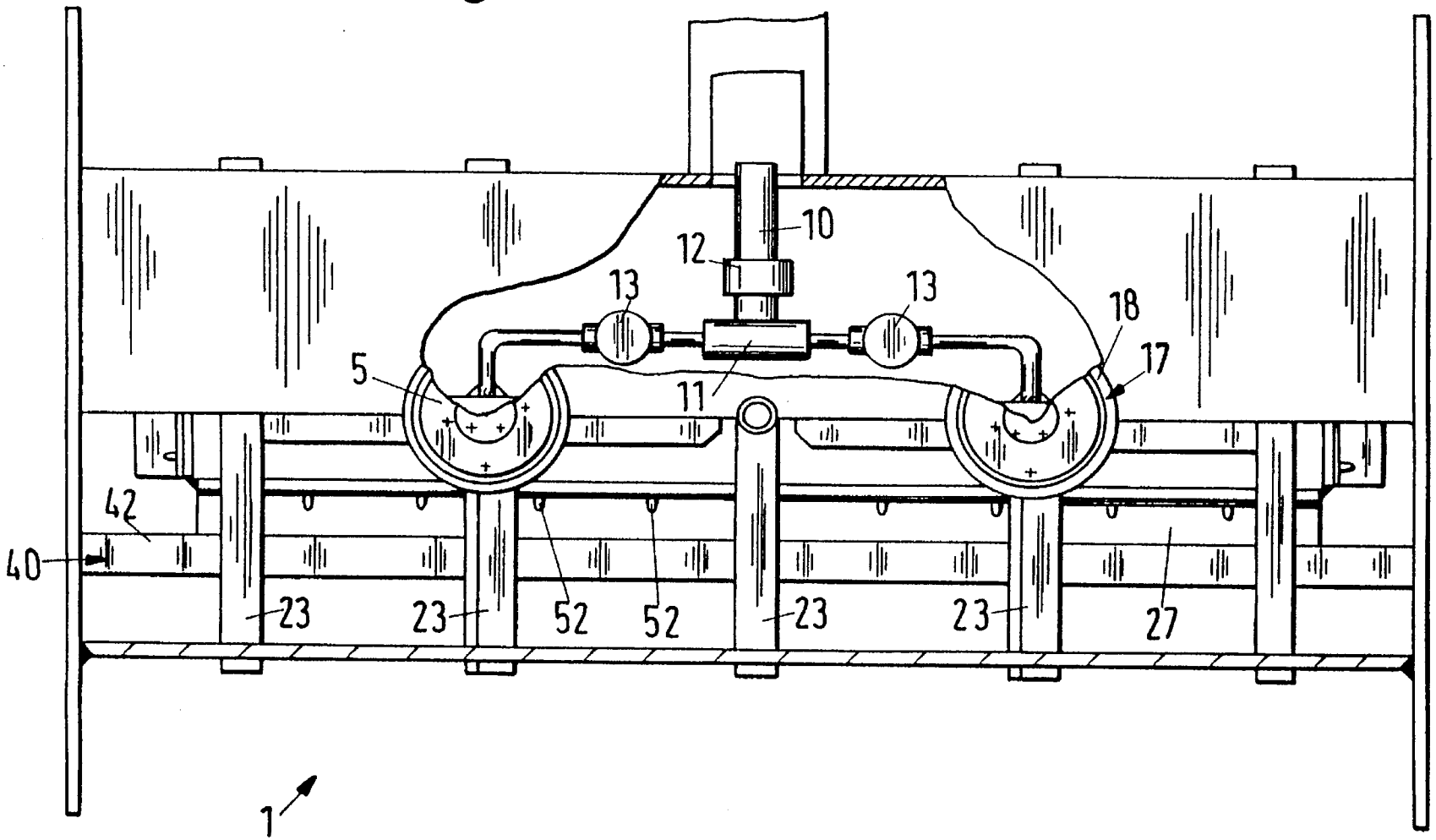
FIG. 4 shows a layout of the spinning beam in accordance with FIG. 2.
Figure 5A:
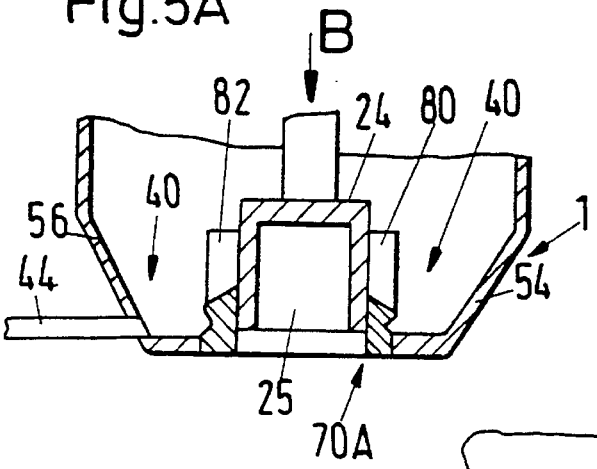
FIGS. 5A and 5B show an alternative arrangement of the heat receiving elements, with FIG. 5B showing a view in the direction of arrow B in FIG. 5A, and FIGS. 6A and 6B show a further embodiment of the heat receiving elements at the upper end of the throat for the nozzle package, with FIG. 6B showing a view in the direction of arrow B in FIG. 6A.
Figure 5B:
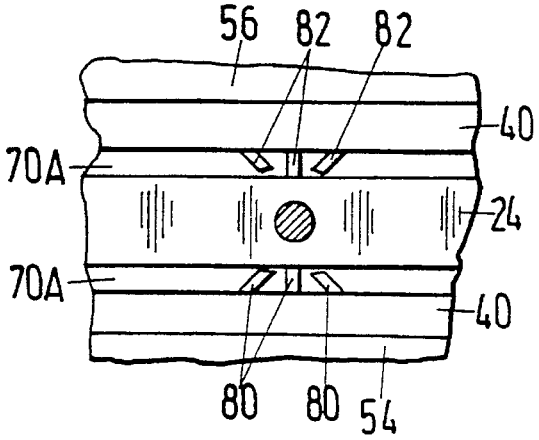

The parts which in the embodiments of FIGS. 5A–5B and 6A–6B are identical with the parts in FIGS. 2 to 4 are shown with the same reference numerals. Such parts shall not be described herein again. Instead of longitudinal ribs 27 in accordance with FIG. 2 the frame 70A in accordance with FIGS. 5A–5B is provided with six fins for each nozzle block, which fins are arranged in two groups of three fins each, with the fins of the one group being provided in FIGS. 5A–5B with reference numeral 80 and those of the other group with reference numeral 82. FIG. 5B shows that every fin is arranged as a thin plate in a "plane" which is substantially radial. The inner edges of the fins 82 which are attached to nozzle block 24 are grouped around the respective end of the one heat bridge. The fins 80 of the other group are arranged accordingly opposite of the end of the second heat bridge, i.e., the groups are each concentrated in the zone of a heat group.

Figure 6A:
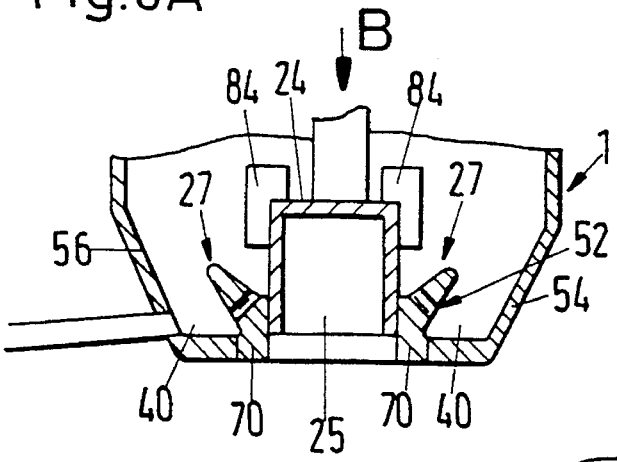
Figure 6B:
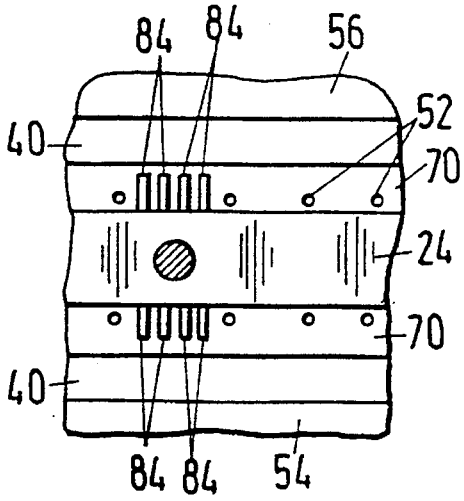

In the modification in accordance with FIGS. 6A–6B, the lower section of the nozzle block is attached in a frame 70 with ribs 27 in accordance with FIG. 2. In addition, the upper part of each block is provided with eight fins 84 which are subjected to the saturated vapor in the centre of the heating box and which guide heat from this vapor to the nozzle block 24. Therefore, the heat transmission is improved not only via the lower heat bridges, but also via the upper heat bridge (i.e., via the seal). Of course, the fins can also be extended downwardly so as to form fins 80, 82 additionally and to replace ribs 27. In the event that the nozzle package is not provided with any heat bridges in the lower section, fins or ribs can obviously only be provided on the upper end of the nozzle block so as to improve the heat transmission via the seal in any case. Even if no attachment means for the nozzle package is provided in the lower section, a heat guiding element can be provided between the package and its carrier in any case for improving the heat transmission onto the spinneret.

The heat receiving elements (e.g., ribs 27 or fins 80, 82, 84) should be made from a highly resistant and highly heat-conductive material preferably metal, for example. In this respect it is necessary to take notice not only of the material of the heat receiving elements per se, but also on the pairing with the nozzle block, so that the advancement of the received heat to the nozzle block may occur free from disturbances and losses.

The heat receiving elements (as well as all other parts of the spinning beam) must meet all security regulations with respect to pressurized vessels. Therefore they are preferably made from steel, e.g., boiler plate or austenitic steel.

Preferably, rib 27 is nowhere less than 5 mm thick, preferably approx. 10 mm or slightly more. The width of rib 27 (i.e., its dimension from the heat bridge to the exposed end) is preferably larger than 20 mm, e.g., 30 mm or slightly more.

What is claimed is:

1. A spinning beam for melt-spinning filaments, comprising:

a heating box, the heating box having a spinneret at a bottom thereof, and the heating box having a profile that tapers downwardly at the bottom in a zone of the spinneret.

2. A spinning beam for melt-spinning filaments, comprising:

a heating box;

consoles rigidly attached to the heating box; and spinning pump drives attached to the consoles.

3. A spinning beam for melt-spinning filaments, comprising:

a heating box;

an evaporator for producing a heat carrier vapor for heating surfaces of the heating box;

a connecting line between the heating box and the evaporator; and insulation for the evaporator and the heating box, wherein the evaporator is integrated in the spinning beam insulation.

4. A spinning beam for the spinning of endless filaments, comprising:

a heating box, the heating box having a throat for removably receiving an exchangeable nozzle package;

an exchangeable nozzle package removably received in the throat;

at least one heat bridge being disposed between the nozzle package and another portion of the beam;

an evaporator for filling the heating box with a vapor heating medium so that heat is conducted to the at least one heat bridge; and a heat receiving element, the element having a surface which is subjected to the heating medium so that the element conducts heat from the heating medium via the surface to the at least one heat bridge such that a temperature drop occurs in a direction away from the heating box.

5. A spinning beam as claimed in claim 4, wherein the heating box includes a plurality of throats for receiving a corresponding plurality of exchangeable nozzle packages, at least one heat bridge being disposed between each nozzle package and another portion of the beam, and one element conducts heat from the heating medium via the surface to the at least one heat bridge disposed between each nozzle package and the portion of the beam such that a temperature drop occurs in a direction away from the heating box.

6. A spinning beam as claimed in claim 5, wherein the element is made in one piece and has a profile which is built into the heating box.

7. A spinning beam as claimed in claim 4, wherein each element corresponds to a single throat.

8. A spinning beam as claimed in claim 4, wherein the element has a cross section which tapers in a direction extending away from the at least one heat bridge.

9. A spinning beam as claimed in claim 4, further comprising means for minimizing contact between condensed heat medium and the at least one heat bridge.

10. A spinning beam as claimed in claim 4, wherein the at least one heat bridge is disposed proximate a lowermost edge section of the throat and the element extends upwardly inclined from the section.

11. A spinning beam as claimed in claim 4, further comprising a melt supply, wherein a heat bridge is disposed proximate the melt supply and at least one element is provided on the throat proximate the exchangeable nozzle package.

* * * * *